US005363778A

United States Patent [19]

Kmiotek et al.

[11] Patent Number: 5,363,778

[45] Date of Patent: Nov. 15, 1994

[54] HIGH EFFICIENCY EXHAUSTER FOR A SOLID FUEL PULVERIZING AND FIRING SYSTEM

[75] Inventors: Stanley E. Kmiotek, Tolland; Peter L. Stanwicks, Windsor, both of Conn.

[73] Assignee: Combustion Engineering, Inc., Windsor, Conn.

[21] Appl. No.: 48,144

[22] Filed: Apr. 15, 1993

[51] Int. Cl.[5] ..... F23K 1/00

[52] U.S. Cl. ..... 110/232; 406/97; 406/100; 416/224; 416/241 B; 416/242

[58] Field of Search ..... 416/224, 241 B, 242; 406/97, 100; 415/121.2; 110/232, 347

[56] References Cited

U.S. PATENT DOCUMENTS

| | | | |
|---|---|---|---|
| 2,616,764 | 11/1952 | Parrish | 416/224 X |
| 3,094,075 | 6/1963 | Logue | 416/224 |
| 3,608,976 | 9/1971 | Zugelder | 406/97 |
| 4,265,592 | 5/1981 | Carlini | 406/97 X |
| 4,531,890 | 7/1985 | Stokes | 416/242 X |
| 4,552,076 | 11/1985 | McCartney | 110/232 X |

*Primary Examiner*—Edward G. Favors
*Attorney, Agent, or Firm*—Arthur E. Fournier, Jr.

[57] ABSTRACT

A high efficiency exhauster which is capable of attaining operating efficiencies of up to 70% when employed in a solid fuel pulverizer firing system that includes a pulverizer which is operative to effect the pulverization therewithin of the solid fuel supplied thereto and a furnace into which the pulverized solid fuel is injected for combustion therewithin. The high efficiency exhauster includes a casing, an inlet ring supported on the casing, a rotor mounted on the casing for rotation therewithin, a multiplicity of blades, each of a preestablished length and width, mounted in spaced relation one to another on the circumference of the rotor so as to extend at a preestablished angle, and an outlet formed in the casing.

11 Claims, 5 Drawing Sheets

HIGH EFFICIENCY EXHAUSTER FOR A SOLID FUEL PULVERIZING AND FIRING SYSTEM

BACKGROUND OF THE INVENTION

This invention relates to solid fuel pulverizing and firing systems for fossil fuel furnaces of the type, wherein the fossil fuel furnace and a substantial portion of the solid fuel pulverizing and firing system by means of which solid fuel and air is supplied to the fossil fuel furnace, are operated at a predetermined pressure, and more specifically, to a high efficiency exhauster employable in such solid fuel pulverizing and firing systems for fossil fuel furnaces.

There are three basic types of solid fuel pulverizer firing systems in use today. These are the direct-fired system, the semi-direct fired system, and the bin storage system. The simplest and most commonly used of these three systems, and the one to which the present invention is directed, is the direct-fired system. The nature of this latter system is such that solid fuel, e.g., coal, is fed in a suitable manner along with hot gases to a pulverizer. The solid fuel is simultaneously ground and dried within the pulverizer. The drying of the solid fuel is effected by the hot gases as the latter sweep through the pulverizer. As the hot gases sweep through the pulverizer they are cooled and humidified by means of the evaporation of the moisture contained in the solid fuel. Often, an exhauster is employed for purposes of removing the hot gases and the entrained fine solid fuel particles, i.e., the solid fuel that has been ground within the pulverizer, from the pulverizer. Moreover, this exhauster, when so employed, is located on the discharge side of the pulverizer and is operative to effect the delivery of the mixture of hot gases and entrained fine solid fuel particles to a fossil fuel furnace. The main advantages of the direct-fired system are simplicity, low cost and maximum safety. To this end, the fine solid particles, which can be subject to spontaneous combustion and thus are considered to be potentially hazardous, go directly to the fossil fuel furnace at high velocities, and thus are not given the opportunity to collect and possibly ignite spontaneously. Accordingly, the direct-fired system can be operated at the maximum temperatures that safety will permit.

One prior art form of such a direct-fired solid fuel pulverizer firing system is depicted in U.S. Pat. No. 3,205,843 entitled "Pulverized Coal Firing System", which issued on Sep. 14, 1965 and which was assigned to the same assignee as the present patent application. In accordance with the teachings of U.S. Pat. No. 3,205,843, solid fuel passes through the inlet chute 23 of the pulverizer 26 on to the rotating bowl 32 thereof. The solid fuel thus admitted to the pulverizer 26 is pulverized therewithin by means of the grinding rollers 36 of the pulverizer 26, which are mounted within the pulverizer housing to provide a grinding action between the grinding rollers 36 and the grinding ring provided on the rotating bowl 32 of the pulverizer 26. Air passes up through the pulverizer 26 between the housing thereof and the rim of the rotating bowl 32 and as the air passes the rotating bowl 32, pulverized solid fuel is entrained in this air with the air-pulverized solid fuel mixture passing up into the classifier 40 of the pulverizer 26, which is located in the upper portion of the pulverizer 26. The classifier 40 is effective to separate the coarse solid fuel fractions and return these fractions to the rotating bowl 32 of the pulverizer for regrinding, while the fines retained in the air stream pass through the outlet 42 of the pulverizer 26, which is located at the upper end of the classifier 40. From this outlet 42 of the pulverizer 26, the air-pulverized solid fuel mixture is conveyed to the inlet of the exhauster 46 via conduit 44. The air-pulverized solid fuel mixture in mm is conveyed from the exhauster 46 to the fossil fuel furnace 10 through the ducts 48.

Another prior art form of such a direct-fired solid fuel pulverizer firing system is depicted in U.S. Pat. No. 4,552,076 entitled "Coal Fired Furnace Light-Off and Stabilization Using Microfine Pulverized Coal", which issued on Nov. 12, 1985 and which is assigned to the same assignee as the present patent application. In accordance with the teachings of U.S. Pat. No. 4,552,076, solid fuel is delivered to the load-carrying pulverizer 20 wherein the solid fuel is ground to pulverized solid fuel and dried by hot air. The pulverized solid fuel is entrained in the pulverizer 20 in the hot air passing therethrough to dry the solid fuel and is drawn from the pulverizer 20 by exhauster 22 and conveyed through the main fuel pipes 24 to the load-carrying burners 18 for combustion in the fossil furnace 10.

With further reference to the teachings of the prior art, there is disclosed in U.S. Pat. No. 2,250,844 entitled "Centrifugal Fan", which issued on Jul. 29, 1941 and which was assigned to the same assignee as the present patent application, an exhauster of the type designed to be employed in a solid fuel pulverizer firing system. In accordance with the teachings of U.S. Pat. No. 2,250,844, solid fuel, which is delivered to the bowl 4 of the pulverizer 1, is thrown centrifugally against a grinding ring 8, crushed under rollers 9 and spills over the top edge of the grinding ring 8. Thence it is carried by an air current flowing upward around the grinding ring 8 through space 14 into a classifier 17. The coarse material travels downwardly through the bottom 18 of the classifier 17 back into the interior of the pulverizer 1, while the fine material passes upwardly in a current of air into a conduit 21 leading to an exhauster 22. The material after passing through the intake of the exhauster 22 into the interior thereof passes across the blades 20 thereof. The mixture of pulverized solid fuel and air is then delivered by the exhauster 22 through a conduit 23 to the place of use, i.e., a fossil furnace (not shown).

Although solid fuel pulverizer firing systems constructed in accordance with the teachings of the three issued U.S. patents to which reference has been made heretofore have been demonstrated to be operative for the purpose for which they have been designed, there has nevertheless been evidenced in the prior art a need for such solid fuel pulverizer firing systems to be further improved, and more specifically, a need for the exhauster employed therein to be improved. Exhausters constructed in accordance with the present day designs commonly have operating efficiencies that are on the order of 55%. A limiting factor insofar as the operating efficiency of exhausters is concerned has heretofore been the need to facilitate maintenance particularly on the rotor portion thereof. The need for such maintenance is occasioned principally by the fact that the material which is transported through the exhauster is extremely abrasive. To this end, a need has thus been evidenced in the prior art for a new and improved solid fuel pulverizer firing system, and more specifically for a new and improved exhauster for such solid fuel pulverizer firing systems that would be capable of operating at efficiencies of up to 70%.

Moreover, there has been evidenced in the prior art a need for such a new and improved exhauster for such solid fuel pulverizer firing systems that would further be characterized in a number of additional respects. One such additional characteristic which such a new and improved exhauster for such solid fuel pulverizer firing systems would desirably possess is the capability to vary the position in which the blades are mounted therewithin. Another such additional characteristic which such a new and improved exhauster for such solid fuel pulverizer firing systems would desirably possess is the capability, by virtue of varying the position in which the blades are mounted therewithin, of attaining optimum airflow therewith. A third such additional characteristic which such a new and improved exhauster for such solid fuel pulverizer firing systems would desirably possess is the capability of realizing therewith such optimum airflow with little or no increase in power consumption. A fourth such additional characteristic which such a new and improved exhauster for such solid fuel pulverizer firing systems would desirably possess is the capability, by virtue of varying the position in which the blades are mounted therewithin, of reducing therewith the amount of erosion to which the interior surfaces of the exhauster are subjected. A fifth such additional characteristic which such a new and improved exhauster for such solid fuel pulverizer firing systems would desirably possess is the capability of achieving therewith an even greater reduction in the amount of erosion to which the interior surfaces of the exhauster are subjected by applying a coating of high abrasion resistant material to such surfaces. A sixth such additional characteristic which such a new and improved exhauster for such solid fuel pulverizer firing systems would desirably possess is the capability of realizing therewith a reduction in the amount of leakage of airflow therefrom as contrasted to that from which prior art forms of exhausters are known to suffer. A seventh such additional characteristic which such a new and improved exhauster for such solid fuel pulverizer firing systems would desirably possess is that the exhauster would be capable of embodying all of the above-enumerated characteristics while yet retaining the existing casing of an exhauster.

It is, therefore, an object of the present invention to provide a new and improved exhauster for use in solid fuel pulverizer firing systems.

It is a further object of the present invention to provide such a new and improved exhauster for solid fuel pulverizer firing systems which is characterized by its high efficiency as compared to that which has been attainable heretofore with prior art forms of exhausters.

It is another object of the present invention to provide such a new and improved exhauster for solid fuel pulverizer firing systems which is characterized in that it is possible therewith to vary the position in which the blades thereof are mounted therewithin.

It is still another object of the present invention to provide such a new and improved exhauster for solid fuel pulverizer firing systems which is characterized in that by varying the position in which the blades thereof are mounted therewithin it is possible to attain therewith optimum airflow.

Another object of the present invention is to provide such a new and improved exhauster for solid fuel pulverizer firing systems which is characterized in that it is possible therewith to realize such optimum airflow with little or no increase in power consumption.

A still another object of the present invention is to provide such a new and improved exhauster for solid fuel pulverizer firing systems which is characterized in that by varying the position in which the blades thereof are mounted therewithin it is possible to reduce therewith the amount of erosion to which the interior surfaces of the exhauster are subjected.

A further object of the present invention is to provide such a new and improved exhauster for solid fuel pulverizer firing systems wherein it is possible to achieve therewith an even greater reduction in the amount of erosion to which the interior surfaces of the exhauster are subjected by applying a coating of high abrasion resistant material to such surfaces.

A still further object of the present invention is to provide such a new and improved exhauster for solid fuel pulverizer firing systems wherein it is possible to realize therewith a reduction in the amount of leakage of airflow therefrom as contrasted to that from which prior an forms of exhausters are known to suffer.

Yet an object of the present invention is to provide such a new and improved exhauster for solid fuel pulverizer firing systems which is characterized in that it is possible therewith to achieve all of the foregoing within the existing casing of an exhauster.

Yet a further object of the present invention is to provide such a new and improved exhauster for solid fuel pulverizer firing systems which is characterized in that use may be made thereof either in retrofit applications or in new applications.

Yet another object of the present invention is to provide such a new and improved exhauster for solid fuel pulverizer firing systems which is characterized in that it is relatively simple in construction, relatively easy to operate, yet is relatively inexpensive to provide.

SUMMARY OF THE PRESENT INVENTION

In accordance with one aspect of the present invention there is provided a high efficiency exhauster that is capable of achieving operating efficiencies of up to 70% when employed in a solid fuel pulverizer firing system. The subject high efficiency exhauster includes a casing having an end wall that is suitably supported in interposed relation between a pair of sidewalls that are spaced relative to each other such that the casing thereby embodies a substantially cylindrical configuration. An inlet ring is suitably supported in mounted relation on one of the pair of sidewalls of the casing such as to be located substantially at the center thereof. The inlet ring functions as the inlet through which pulverized solid fuel entrained in an airstream enters into the interior of the casing. A rotor is suitably supported in mounted relation on the other one of the pair of sidewalls of the casing so as to be located within the casing for rotation relative thereto. A multiplicity of blades are mounted on the rotor so as to be rotatable therewith. Each of the multiplicity of blades has a fixed end and a free end. The fixed ends of the multiplicity of blades are mounted on the circumference of the rotor in spaced relation one to another such that the multiplicity of blades extend in a direction counter to the direction of rotation of the rotor and at a preestablished angle relative to an imaginary line drawn perpendicular to the circumference of the rotor through the point at which the corresponding one of the fixed ends of the multiplicity of blades is affixed to the circumference of the rotor.

The angle at which the multiplicity of blades extend relative to the circumference of the rotor is established based on a consideration of the specific flow and static pressure characteristics that the subject high efficiency exhauster is required to embody in order that the subject high efficiency exhauster may attain an operating efficiency of up to 70% when being employed in the application for which it has been designed. For purposes of reducing the amount of erosion incurred thereby, at least the flow engaging surface of each of the multiplicity of blades is provided with a layer, either in the form of a coating applied thereto or in the form of a separate liner mounted thereon, of a high abrasion resistant material such as saturated chromium carbide. After passing through the interior of the subject high efficiency exhauster the pulverized solid fuel entrained in an airstream exits therefrom through an outlet suitably formed for this purpose at a preselected location in the end wall of the casing of the subject high efficiency exhauster.

In accordance with another aspect of the present invention there is provided a solid fuel pulverizer firing system wherein the improvement therein resides in a high efficiency exhauster therefor, which is capable of attaining operating efficiencies of up to 70% when so employed. The subject solid fuel pulverizer firing system includes a pulverizer operative to effect the pulverization therewithin of the solid fuel supplied thereto. The pulverizer is connected in fluid flow relation to a high efficiency exhauster whereby the solid fuel that is pulverized within the pulverizer is entrained in an airstream and while so entrained therein is conveyed from the pulverizer to the high efficiency exhauster. The high efficiency exhauster includes a casing, an inlet ring supported on the casing so as to be operative as the inlet through which the pulverized solid fuel while entrained in an airstream enters into the interior of the casing, a rotor mounted on the casing for rotation therewithin, a multiplicity of blades having the fixed ends thereof mounted on the circumference of the rotor in spaced relation one to another such that the multiplicity of blades extend in a direction counter to the direction of rotation of the rotor and at a preestablished angle relative to an imaginary line drawn perpendicular to the circumference of the rotor through the point at which the corresponding one of the fixed ends of the multiplicity of blades is affixed to the circumference of the rotor and wherein the angle at which the multiplicity of blades extend relative to the circumference of the rotor is established based on a consideration of the specific flow and static pressure characteristics that the subject high efficiency exhauster is required to embody in order that the high efficiency exhauster may attain an operating efficiency of up to 70% when being employed in the application for which it has been designed, at least the flow engaging surfaces of the multiplicity of blades are provided with a layer of a high abrasion resistant material, and an outlet formed in the casing through which the pulverized solid fuel while entrained in an airstream is designed to exit from the high efficiency exhauster after having passed through the interior thereof. The high efficiency exhauster is connected in fluid flow relation with a furnace whereby the pulverized solid fuel while entrained in an airstream is conveyed from the high efficiency exhauster to the furnace for injection thereinto.

DESCRIPTION OF THE PREFERRED EMBODIMENT

Figure 1:
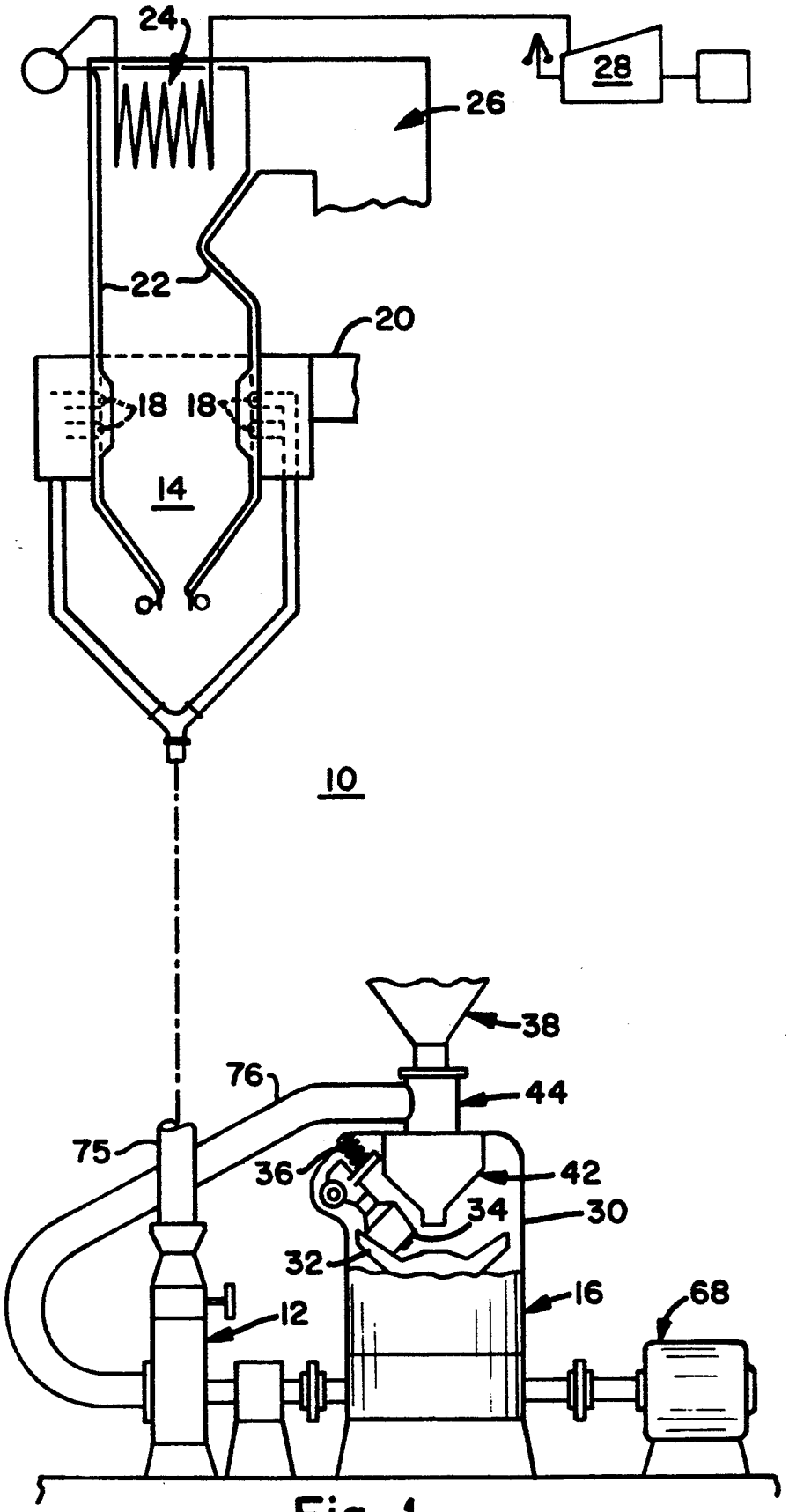
FIG. 1 is a schematic representation of a solid fuel pulverizer firing system embodying a high efficiency exhauster constructed in accordance with the present invention.

Referring now to the drawing, and more particularly to FIG. 1 thereof, there is depicted therein a solid fuel pulverizer firing system, generally designated by reference numeral 10. Inasmuch as the nature of the construction and the mode of operation of solid fuel pulverizer firing systems per se are well-known to those skilled in the art, it is not deemed necessary, therefore, to set forth herein a detailed description of the solid fuel pulverizer firing system illustrated in FIG. 1. Rather, for purposes of obtaining an understanding of a solid fuel pulverizer firing system 10, which is capable of having cooperatively associated therewith a high efficiency exhauster, generally designated by the reference numeral 12 in FIG. 1 of the drawing, that in accordance with the present invention is capable of being employed therein and when so employed therein the high efficiency exhauster 12 is capable of attaining operation efficiencies of up to 70%, it is deemed to be sufficient that there be presented herein merely a description of the major components of the solid fuel pulverizer firing system 10 with which the aforesaid high efficiency exhauster 12 is cooperatively associated. For a more detailed description of the nature of the construction and the mode of operation of the components of the solid fuel pulverizer firing system 10, which are not described herein, one may have reference to the prior art, e.g., U.S. Pat. No. 3,205,843, which issued Sep. 14, 1963 to A. Bogot.

As illustrated in FIG. 1 of the drawing, the principal components of the solid fuel pulverizer firing system 10 are a furnace, generally designated by the reference numeral 14, the high efficiency exhauster 12 to which reference has been had herein previously, and a pulverizer, generally designated by the reference numeral 16. With respect to both the furnace 14 and the pulverizer 16, a brief description of each will next be had herein. On the other hand, a detailed description of the nature of the construction and the mode of operation of the high efficiency exhauster 12, constructed in accordance with the present invention, will be set forth herein subsequently.

Considering first the furnace 14, it is within the furnace 14 that in a manner well-known to those skilled in this art combustion of the pulverized solid fuel and air is initiated. To this end, in a manner to which further reference will be had herein subsequently, the pulverized solid fuel and air is injected into the furnace 14 through the burners, which are schematically depicted at 18 in FIG. 1 of the drawing. In addition to the aforementioned pulverized solid fuel and air, there is also supplied to the furnace 14 the secondary air, which is required to effectuate the combustion within the furnace 14 of the pulverized solid fuel that is injected thereinto through the burners 18. More specifically, this secondary air, as best understood with reference to FIG. 1 of the drawing, is supplied to the furnace 14 through a duct, a portion of which can be seen at 20 in FIG. 1.

The hot gases that are produced from construction of the pulverized solid fuel and air rise upwardly in the furnace 14. During the upwardly movement thereof in the furnace 14, the hot gases in a manner well-known to those skilled in this art give up heat to the fluid passing through the tubes, which are schematically depicted at 22 in FIG. 1, that in conventional fashion line all four of the walls of the furnace 14. Then, the hot gases exit the furnace 14 through the horizontal pass, generally designated by the reference numeral 24 of the furnace 14, which in turn leads to the rear gas pass, generally designated by the reference numeral 26 of the furnace 14. Both the horizontal pass 24 and the rear gas pass 26 commonly contain other heat exchanger surface (not shown) for generating and super heating steam, in a manner well-known to those skilled in this art. Thereafter, the steam commonly is mode to flow to a turbine, generally designated by the reference numeral 28 in FIG. 1, which is in turn connected to a variable load, such as an electric generator (not shown), which in known fashion is cooperatively associated with the turbine 28, such that electricity is thus produced from the generator (not shown).

Next, a brief description will be had herein of the pulverizer 16. For this purpose, reference will be had in particular to FIG. 2 of the drawing. Thus, as best understood with reference to FIG. 2 the pulverizer 16 includes a substantially closed separator body, shown therein at 30. A grinding table, seen therein at 32, is mounted on a shaft (not shown), which in turn is operatively connected to a suitable drive mechanism (not shown) so as to be capable of being rotatably driven thereby. Continuing with the description of the pulverizer 16, a plurality of grinding rolls, preferably three in number in accord with conventional practice, are suitably supported within the interior of the separator body 30 so as to be equidistantly spaced one from another around the circumference of the separator body 30. In the interest of maintaining clarity of illustration in the drawing, only one such grinding roll, denoted therein by the reference numeral 34, is shown in both FIG. 2 and in FIG. 1. With further regard to the grinding roll 34, the latter as best understood with reference to the drawing is preferably supported on a shaft, which in turn is cooperatively associated with some form of biasing means. In accord with the illustration of the pulverizer 16 in the drawing, this biasing means takes the form of spring means, denoted by the reference numeral 36 in both FIG. 2 and in FIG. 1 of the drawing. The spring means 36 is intended to be operative to urge the shaft and thereby also the grinding roll 34 cooperatively associated therewith towards the surface of the grinding table 32. Commonly, the spring means 36 is provided with some form of adjustment means through the operation of which adjustments can be made in the spacing that exists between the grinding roll 34 and the surface of the grinding table 32 on which the pulverization of the solid fuel, e.g., coal, occurs.

Figure 2:
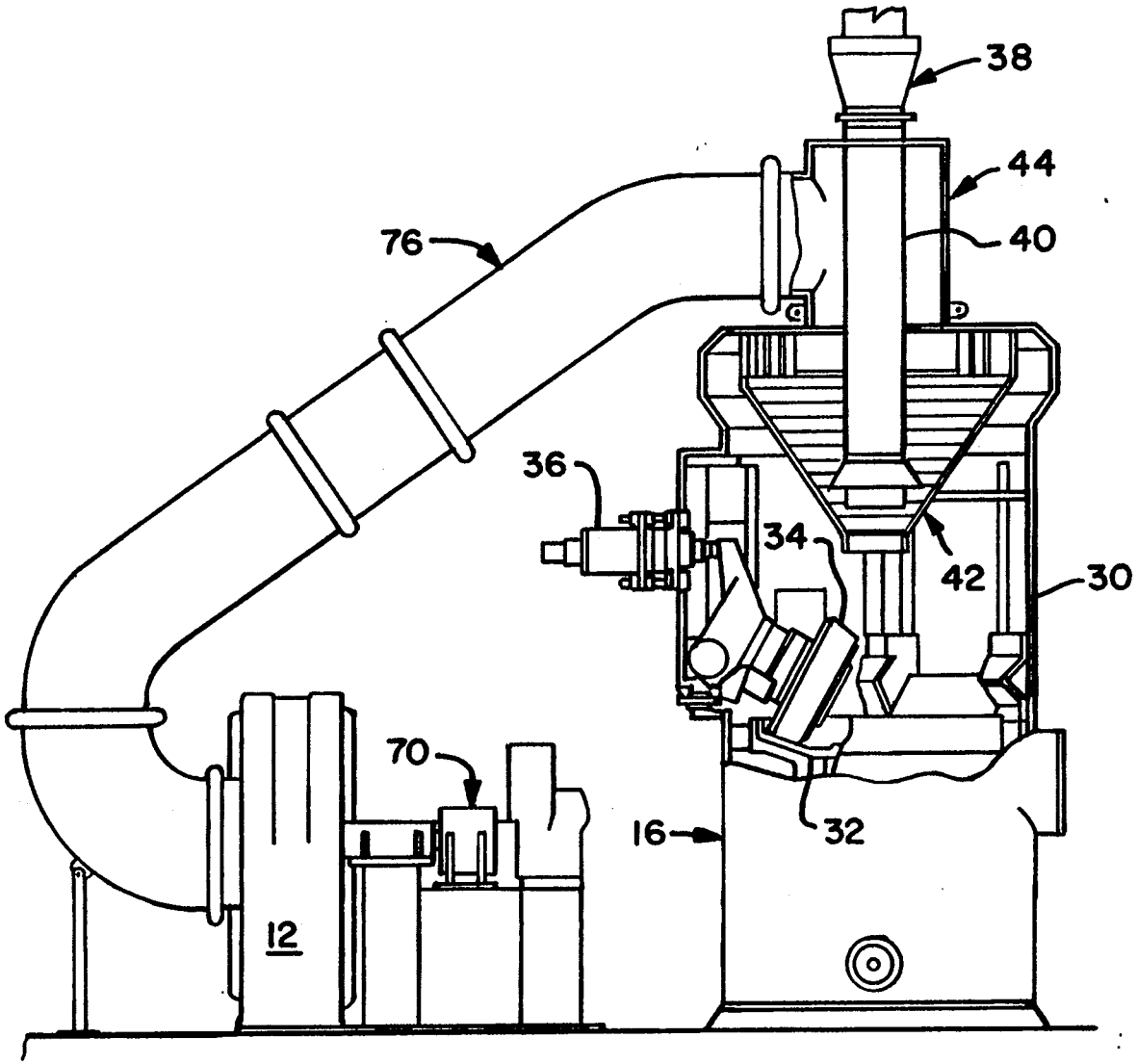
FIG. 2 is a schematic representation partially in section of a portion of a solid fuel pulverizer firing system, illustrating a pulverizer and a high efficiency exhauster, constructed in accordance with the present invention.

The solid fuel, e.g., coal, that is to be pulverized in the pulverizer 16 is fed thereto by means of any suitable conventional form of feed means (not shown). Upon being discharged from the feed means (not shown), the solid fuel enters the pulverizer 16 by means of a solid fuel supply means, generally designated by the reference numeral 38, with which the pulverizer 16 is suitably provided. In accordance with the embodiment of the pulverizer 16 illustrated in the drawing, the solid fuel supply means 38 includes, as shown in FIG. 2, a suitably dimensioned duct 40 having one end thereof which extends outwardly of the separator body 30. The other end of the duct 40 is operative to effect the discharge of the solid fuel onto the surface of the grinding table 32.

In accord with the mode of operation of pulverizers that embody the form of construction depicted in the drawing, a gas such as air is utilized to effect the conveyance of the solid fuel from the grinding table 32 through the interior of the separator body 30 for discharge from the pulverizer 16. The air that is used in this connection enters the separator body 30 through a suitable opening provided therein for this purpose. From this opening in the separator body 30, the air flows in surrounding relation from beneath the grinding table 32 to above the surface of the latter. More specifically, the air flows through the space provided for this purpose between the inner wall surface of the separator body 30 and the circumference of the grinding table 32.

As the air is made to flow through the interior of the pulverizer 16, the solid fuel which is dispensed on the surface of the grinding table 32 is being pulverized by the action of the grinding roll 34. As the solid fuel becomes pulverized, the particles that result therefrom are thrown outwardly by centrifugal force away from the center of the grinding table 32. Upon reaching the region of the circumference of the grinding table 32, the solid fuel particles are picked up by the air flowing upwardly from beneath the grinding table 32 and are carried away therewith. Thereafter, the stream of air with the solid fuel particles entrained therein follows a tortuous path through the interior of the pulverizer 16. Moreover, in the course of following this tortuous path the larger of the solid fuel particles are caused to be separated from the air stream in which they are entrained and are made to return to the surface of the grinding table 32 whereupon they undergo further pulverization. The lighter of the solid fuel particles, on the other hand, continue to be carried along in the air stream. Ultimately, the combined stream of air and those solid fuel particles that remain entrained therein flows to the classifier, which is generally designated by reference numeral 42 in the drawing.

The classifier 42, in accord with conventional practice and in a manner well-known to those skilled in the art, operates to effect a further sorting of the solid fuel particles that remain in the air stream. Namely, those particles of pulverized solid fuel, which are of the desired particle size, pass through the classifier 42 and along with the air, in a manner that will be more fully described hereinafter, are discharged therefrom and thereby from the pulverizer 16 through the outlet, generally designated by reference numeral 44 in the drawing, with which the pulverizer 16 is provided for this purpose. On the other hand, those solid fuel particles which in size are larger than desired, are returned to the surface of the grinding table 32 whereupon they undergo additional pulverization. Thereafter, these solid fuel particles are subject to a repeat of the process described above. That is, the particles are thrown outwardly of the grinding table 32, are picked up by the air exiting from beneath the grinding table 32, and are carded along with the air through the tortuous path that is provided therefor through the interior of the pulverizer 16. As the air stream follows the tortuous path the heavier particles drop back onto the grinding table 32. The lighter particles though continue to be carded along with the air to the classifier 42, while those particles which are of the proper size pass through the classifier 42 and exit from the pulverizer 16 through the outlet 44.

With the preceding by way of background, reference will now be had particularly to FIGS. 3–7 of the drawing for purposes of describing the high efficiency exhauster 12, which in accordance with the present invention is designed to be employed in a solid fuel pulverizer firing system, such as the solid fuel pulverizer firing system 10 illustrated in FIG. 1 of the drawing, and wherein when so employed therein the high efficiency exhauster 12 is designed to be cooperatively associated with a furnace constructed in the manner of the furnace 14 that is depicted in FIG. 1 of the drawing and with a pulverizer constructed in the manner of the pulverizer 16 that is depicted in FIGS. 1 and 2 of the drawing. More specifically, the high efficiency exhauster 12 is designed to be employed in a solid fuel pulverizer firing system such as the solid fuel pulverizer firing system 10 shown in FIG. 1 of the drawing so that when so employed therein the high efficiency exhauster 12 is capable of achieving operating efficiencies of up to 70%.

Figure 4:
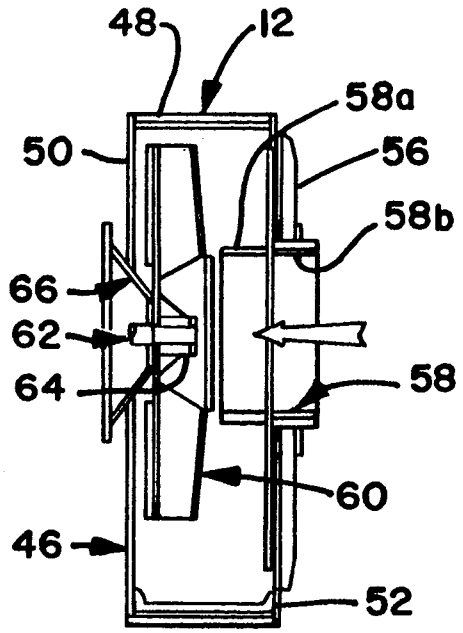
FIG. 4 is an end view of the high efficiency exhauster, constructed in accordance with the present invention, which is employed in the solid fuel pulverizer firing system that is depicted in FIG. 1.
Figure 3:
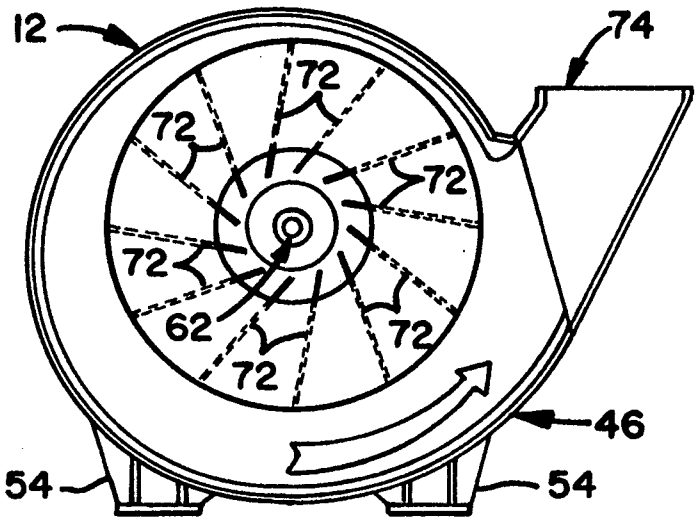
FIG. 3 is a side elevational view of the high efficiency exhauster, constructed in accordance with the present invention, which is employed in the solid fuel pulverizer firing system that is depicted in FIG. 1.
Figure 6:
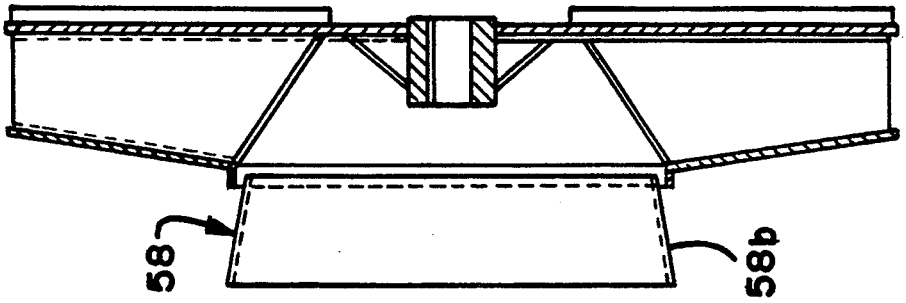
FIG. 6 is an end view of a portion of the high efficiency exhauster, constructed in accordance with the present invention, which is employed in the solid fuel pulverizer firing system that is depicted in FIG. 1.

As best understood with reference to FIGS. 3 and 4 of the drawing, the high efficiency exhauster 12 constructed in accordance with the present invention includes a casing, which is generally designated by the reference numeral 46 in FIGS. 3 and 4. One of the important characteristics of the design of the high efficiency exhauster 12 constructed in accordance with the present invention is that the casing 46 embodies essentially the same configuration and dimensions as the casings that have to date been employed in prior art forms of exhausters. This is particularly significant with respect to retrofit applications inasmuch as it therefore enables prior art forms of exhausters to be modified pursuant to the teachings of the present invention such that such prior art forms of exhausters can thus be rendered capable of achieving operating efficiencies up to 70% whereas without such modifications such prior art forms of exhausters would at most be capable of achieving operating efficiencies of 55%.

Continuing with the description of the high efficiency exhauster 12, in accord with the preferred embodiment of the invention, the casing 46 thereof, as best understood with reference to FIG. 4 of the drawing, includes an end wall, denoted in the drawing by the reference numeral 48, and a pair of side walls, denoted in the drawing by the reference numerals 50 and 52, respectively. The end wall 48 is suitably supported between the pair of side walls 50 and 52, through the use of any conventional form of supporting means suitable for use for such a purpose such as by being welded thereto, whereby the casing 46 embodies a substantially cylindrical configuration. In addition, the casing 46, as best understood with reference to FIG. 3 of the drawing, is preferably provided with a pair of support members, each denoted in the drawing for ease of reference by the same reference numeral, i.e., the reference numeral 54. The support members 54 are designed to be operative to enable the casing 46, notwithstanding its cylindrical configuration, and thereby the high efficiency exhauster 12 as well to be positioned on a substantially flat surface.

With further regard to the casing 46, in accordance with the preferred embodiment of the invention the casing 46 also has cooperatively associated therewith a cover, generally designated by the reference numeral 56. More specifically, the cover 56, as best understood with reference to FIG. 4 of the drawing, is designed to be detachably mounted on the side wall 52 of the casing 46 through the use of any conventional form of mounting means suitable for use for such a purpose such that the cover 56 can be detached from the side wall 52 whereby to provide access to the interior of the casing, and in particular the components housed therewithin, should such access be desired for purposes of maintenance and/or any, other purposes.

Continuing, the casing 46 additionally has cooperatively associated therewith an inlet ring, generally designated by the reference numeral 58. The inlet ring 58, as best understood with reference to FIG. 4 of the drawing, is designed to be mounted in juxtaposed relation to an opening (not shown) with which the side wall 52 of the casing 46 is suitably provided substantially at the center thereof. More specifically, the inlet ring 58 is designed so as to be so mounted relative to the aforementioned opening (not shown) such that the inlet ring 58 has a portion thereof, denoted in FIG. 4 of the drawing by the reference numeral **58*a*, that projects into the interior of the casing 46, and a portion thereof, denoted in FIG. 4 of the drawing by the reference numeral 58*b*, that is located exteriorly of the casing 46. For ease of illustration, the side walls of the portion 58*b* of the inlet ring 58 are depicted in FIG. 4 of the drawing as being straight. Preferably, however, the side walls of the portion 58*b* of the inlet ring 58 are designed so as to be inclined inwardly in the manner that has been depicted in FIG. 6 of the drawing. As such, the portion 58*b* of the inlet ring 58, in accordance with the depiction in FIG. 6, embodies a configuration much like that of a funnel. The inlet ring 58, as will be described more fully hereinafter, is operative as an inlet through which pulverized solid fuel entrained in an airstream enters into the interior of the casing 46. In accordance with the best mode embodiment of the invention, the inlet ring 58 is preferably operatively connected to the cover 56 through the use of any conventional form of connecting means suitable for use for such a purpose such as by being welded thereto, whereby the cover 56 and the inlet ring 58 are thus capable of being detachably removed from the casing 46, and more specifically the side wall 52 thereof, as a single unit. Likewise, for purposes of mounting the cover 56 and the inlet ring 58 on the side wall 52 of the casing 46, the cover 56 and the inlet ring 58** are mountable as a single unit by virtue of being operatively connected one to another.

Continuing with the description of the high efficiency exhauster 12 constructed in accordance with the present invention, there is housed within the casing 46, as best understood with reference to FIGS. 3 and 4 of the drawing, a rotor, generally designated by the reference numeral 60. In accord with the best mode embodiment of the invention, the rotor 60 is so housed within the casing 46 such that the centerline of the rotor 60 is offset relative to the centerline of the casing 46 whereby the circumference of the rotor 60 is located in closer proximity to the inner surface of the end wall 48 along the upper portion of the casing 46 as viewed with reference to FIGS. 3 and 4 of the drawing than it is along the bottom portion of the casing 46 as viewed with reference to FIGS. 3 and 4 of the drawing. The rotor 60 is suitably mounted within the casing 46 so as to be rotatable relative thereto. To this end, the rotor 60 is suitably affixed to a shaft, generally designated in the drawing by the reference numeral 62, so as to thereby be rotatable therewith.

In turn, the shaft 62 is suitably supported within the casing 46 so as to be capable of rotation therewithin. Any conventional form of support means suitable for use for such a purpose may be employed to effect the mounting of the shaft 62 within the casing 46. By way of exemplification and not limitation, one such form of support means is depicted in FIG. 4 of the drawing. Thus, as depicted in FIG. 4 the shaft 62 is suitably supported in known fashion within a hub, denoted in FIG. 4 by the reference numeral 64. The hub 64 in turn is supported through the use of any conventional form of support members suitable for use for such a purpose.

When so mounted, the power that is required to effect the rotation of the shaft 62 and therethrough the rotor 60 is designed to be provided from an external source. That is, the shaft 62 is designed so as to be capable of being operatively connected in known fashion to a conventional motor, which is located externally of the high efficiency exhauster 12 but which is suitably provided as one of the components of a solid fuel pulverizer firing system, such as the solid fuel pulverizer firing system 10 illustrated in FIG. 1 of the drawing. To this end, the shaft 62 may be rotatably driven from a motor, such as that which is generally designated in FIG. 1 of the drawing by the reference numeral 68, and which in accordance with the illustration thereof in FIG. 1 is also designed to be operative to drive the shaft through which rotation is imparted to the grinding table 32 of the pulverizer 16. On the other hand, the shaft 62 without departing from the essence of the present invention may also be rotatably driven from a motor such as that generally designated in FIG. 2 by the reference numeral 70, which is designed to impart rotation solely to the shaft 62 of the high efficiency exhauster 12, and not also to the shaft through which rotation is imparted to the grinding table 32 of the pulverizer 16.

Figure 5:
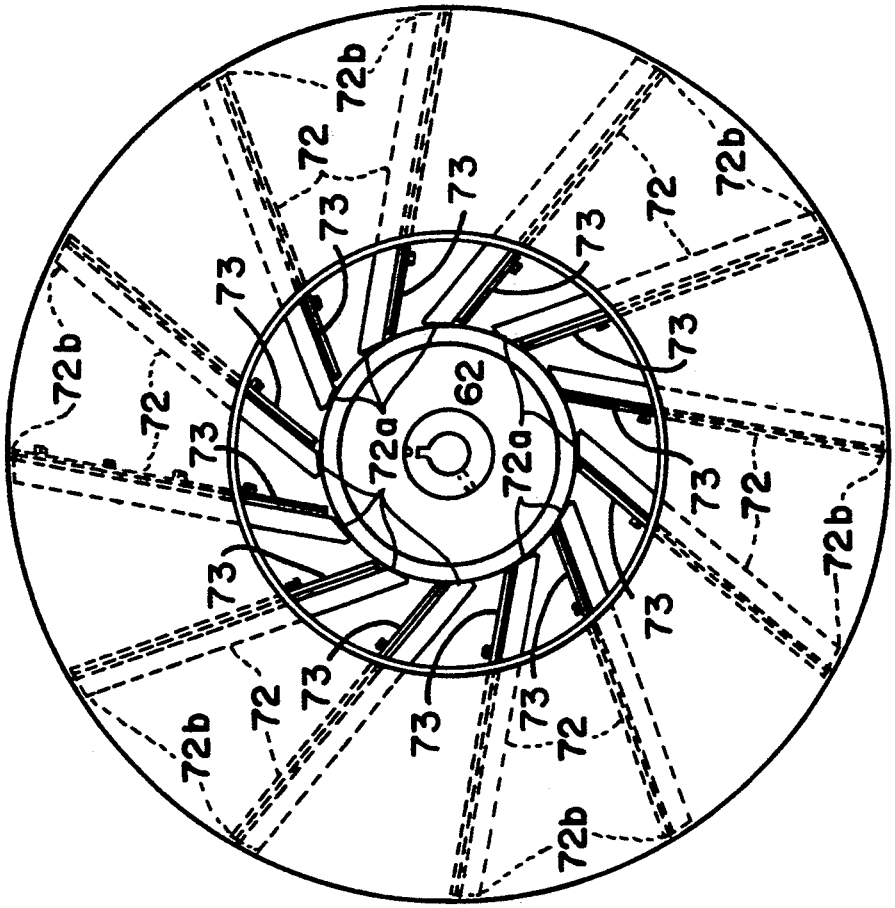
FIG. 5 is a side elevational view, viewed from one side thereof, of a portion of the high efficiency exhauster, constructed in accordance with the present invention, which is employed in the solid fuel pulverizer firing system that is depicted in FIG. 1.
Figure 7:
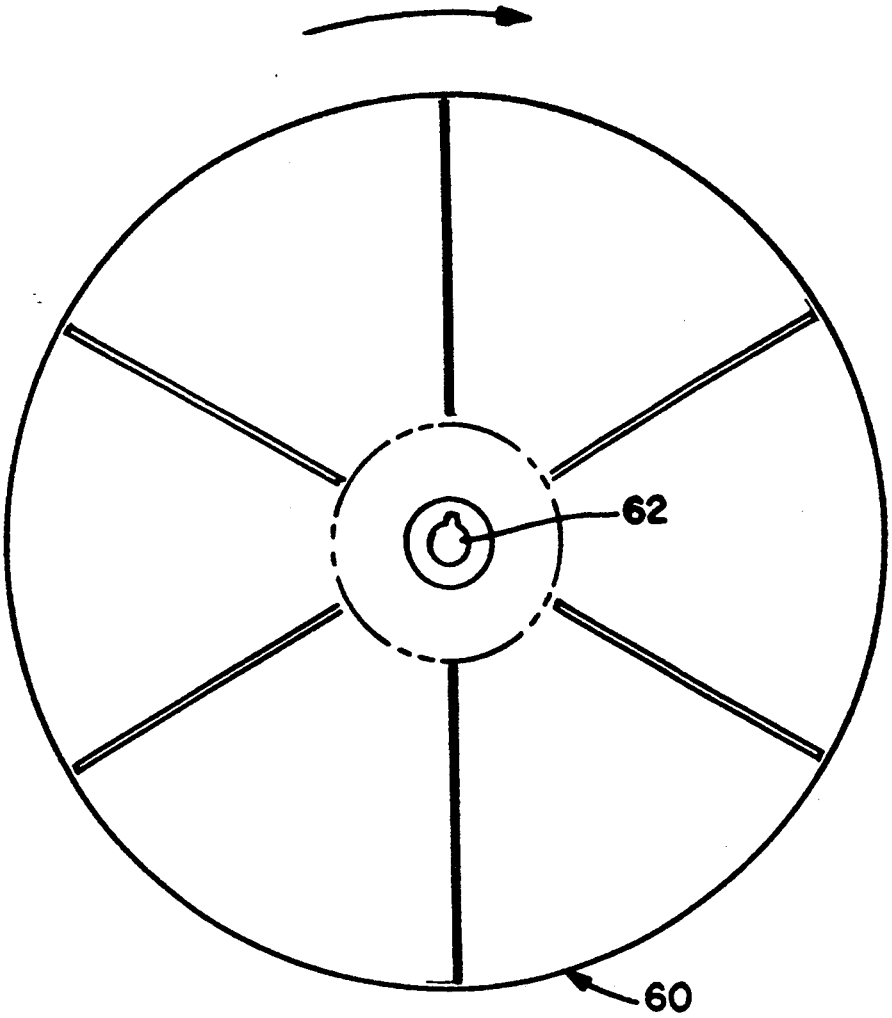
FIG. 7 is a side elevational view, viewed from the other side thereof, of a portion of the high efficiency exhauster, constructed in accordance with the present invention, which is employed in the solid fuel pulverizer firing system that is depicted in FIG. 1.

Referring again to the high efficiency exhauster 12 constructed in accordance with the present invention, and more specifically to the rotor 60 thereof, as best understood with reference to FIGS. 3 and 5 of the drawing the rotor 60 has a multiplicity of blades affixed thereto. For ease of reference, each of the multiplicity of blades is denoted in the drawing by the same reference numeral, i.e., reference numeral 72. In accordance with the best mode embodiment of the invention, the multiplicity of blades 72 comprise a fixed number of blades, i.e., twelve. Each of the multiplicity of blades 72 has a fixed end, denoted in FIG. 5 by the reference numeral **72*a*, and a free end, denoted in FIG. 5 by the reference numeral 72*b*. The fixed ends 72*a* of the multiplicity of blades 72 are suitably supported in mounted relation on the rotor 60 for rotation therewith through the use of any conventional form of mounting means such as by being welded thereto so as to be positioned thereon in spaced relation one to another. Moreover, the fixed ends 72*a* thereof are suitably supported in mounted relation on the rotor 60 such that the multiplicity of blades 72 extend in a direction counter to the direction of rotation of the rotor 60. Further, the fixed ends 72*a* thereof are so mounted such that the multiplicity of blades 72 extend at a preestablished angle relative to an imaginary line drawn perpendicular to the circumference of the rotor 60 through the point at which the corresponding one of the fixed ends 72*a* of the multiplicity of blades 72 is affixed to the circumference of the rotor 60. The angle at which the multiplicity of blades 72 extend relative to the circumference of the rotor 60 is established based on a consideration of the specific flow and static pressure characteristics that the high efficiency exhauster 12 of the present invention is required to embody in order that the high efficiency exhauster 12 may attain an operating efficiency of up to 70% when being employed in a solid fuel pulverizer firing system such as the solid fuel pulverizer firing system 10 that is illustrated in FIG. 1** of the drawing.

Continuing with the description of the nature of the construction of the multiplicity of blades 72, each of the multiplicity of blades 72 as measured from the fixed end **72*a* thereof to the free end 72*b* thereof is of a preestablished length. More specifically, all of the multiplicity of blades 72 of the same high efficiency exhauster 12 are of the same length. However, the length that each of the multiplicity of blades 72 embodies is a function of the specific requirements, i.e., the quantity of flow, static pressure and horsepower, of the particular application in which the high efficiency exhauster 12 is intended to be utilized. That is, the length of all of the multiplicity of blades of the same high efficiency exhauster 12 is preestablished so that they are all of the same length based on the quantity of flow, the static pressure and the horsepower requirements that the high efficiency exhauster 12 is required to satisfy in order to permit its use in a given application. To this end, the shorter the multiplicity of blades 72 are in length, the less the quantity of flow, the less the static pressure and the less the horsepower of the high efficiency exhauster 12. Conversely, if the length of the multiplicity of blades 72 is increased, the quantity of flow that it is possible to achieve through the high efficiency exhauster 12 will increase, the static pressure associated with the high efficiency exhauster 12 will increase and the horsepower used by the high efficiency exhauster 12** will increase.

Likewise, each of the multiplicity of blades 72 is of a preestablished width. More specifically, all of the multiplicity of blades 72 of the same high efficiency exhauster 12 are of the same width. However, the width that each of the multiplicity of blades 72 embodies is a function of the specific requirements, i.e., the quantity of flow, static pressure and horsepower, of the particular application in which the high efficiency exhauster 12 is intended to be utilized. That is, the width of all of the multiplicity of blades 72 of the same high efficiency exhauster 12 is preestablished so that they are all of the same width based on the quantity of flow, the static pressure and the horsepower requirements that the high efficiency exhauster 12 is required to satisfy in order to permit its use in a given application. To this end, for a given static pressure the greater the width of the multiplicity of blades 72, the greater the quantity of flow that it is possible to achieve through the high efficiency exhauster 12 and the greater the horsepower used by the high efficiency exhauster 12. In this regard, for a given static pressure there is a linear relationship between the increase in the quantity of flow and the increase in horsepower. Conversely, for a given static pressure the narrower the width of the multiplicity of blades 72 the less the quantity of flow that it is possible to achieve through the high efficiency exhauster 12 and the less the horsepower used by the high efficiency exhauster 12.

From the preceding, it should thus be readily apparent that it is possible with a high efficiency exhauster 12 constructed in accordance with the present invention to optimize the operation thereof by varying the angle at which the multiplicity of blades 72 extend, by varying the length of the multiplicity of blades 72 and by varying the width of the multiplicity of blades 72. Namely, for any particular application, having specific requirements as to quantity of flow, static pressure and horsepower, in which it is desired to employ the high efficiency exhauster 12 by virtue of the nature of the construction thereof it is possible therewith to adjust the angle at which the multiplicity of blades 72 extend along with the length and the width of the multiplicity of blades 72 such as to satisfy those requirements relating to quantity of flow, static pressure and horsepower while yet achieving operating efficiencies of up to 70% with the high efficiency exhauster 12. In this regard, the efficiency of the high efficiency exhauster 12 is a function of the flow along the surface of each of the multiplicity of blades 72, which in turn is a function of the angle at which the multiplicity of blades 72 extend relative to the circumference of the rotor 60.

For purposes of reducing the amount of erosion incurred thereby, at least the flow engaging surface of each of the multiplicity of blades 72 is provided, as best understood with reference to FIG. 5 with a liner, denoted therein by the reference numeral 73, of a high abrasion resistant material. To this end, a liner 73 may be affixed to the flow engaging surface of each of the multiplicity of blades 72 through the use of any conventional form of fastening means suitable for use for such a purpose such as by being bolted thereto. Although the high abrasion resistant material is depicted as being applied to the flow engaging surface of the multiplicity of blades 72 in the form of a liner, it is also to be understood that without departing from the essence of the invention the high abrasion resistant material could be applied to the flow engaging surface of the multiplicity of blades 72 as a coating rather than in the form of a liner. In accord with the best mode embodiment of the invention the high abrasion resistant material that has been selected for application to the flow engaging surfaces of the multiplicity of blades 72 is saturated chromium carbide or ceramics.

A description will next be had herein of the mode of operation of the solid fuel pulverizer firing system 10 illustrated in FIG. 1 of the drawing. To this end, solid fuel is supplied to and is pulverized within the pulverizer 16. In turn, the pulverizer 16 is connected by means of the duct, denoted by the reference numeral 76, to the high efficiency exhauster 12, and more specifically the inlet ring 58 thereof, whereby the solid fuel that is pulverized within the pulverizer 16 is entrained therewithin in an airstream and while so entrained therein is conveyed from the pulverizer 16 through the duct 76 to the high efficiency exhauster 12. The pulverized solid fuel while still entrained in the airstream enters the high efficiency exhauster 12 through the inlet ring 58 thereof. After being made to pass through the high efficiency exhauster 12 by virtue of the movement of the multiplicity of blades 72 thereof, the pulverized solid fuel while still entrained in the airstream is discharged from the high efficiency exhauster 12 through the outlet thereof, denoted by the reference numeral 74. From the high efficiency exhauster 12 the pulverized solid fuel entrained in the airstream is conveyed to the furnace 14 through the duct denoted in the drawing by reference numeral 75, whereupon the pulverized solid fuel is combusted within the furnace 14.

Thus, in accordance with the present invention there has been provided a new and improved exhauster for use in solid fuel pulverizer firing systems. Besides, there has been provided in accord with the present invention such a new and improved exhauster for solid fuel pulverizer firing systems which is characterized by its high efficiency as compared to that which has been attainable heretofore with prior art forms of exhausters. As well, in accordance with the present invention there has been provided such a new and improved exhauster for solid fuel pulverizer firing systems which is characterized in that it is possible therewith to vary the position in which the blades thereof are mounted therewithin. Moreover, there has been provided in accord with the present invention such a new and improved exhauster for solid fuel pulverizer firing systems which is characterized in that by varying the position in which the blades thereof are mounted therewithin it is possible to attain therewith optimum airflow. Further, in accordance with the present invention there has been provided such a new and improved exhauster for solid fuel pulverizer firing systems which is characterized in that it is possible therewith to realize such optimum airflow with little or no increase in power consumption. Also, there has been provided in accord with the present invention such a new and improved exhauster for solid fuel pulverizer firing systems which is characterized in that by varying the position in which the blades thereof are mounted therewithin it is possible to reduce therewith the amount of erosion to which the interior surfaces of the exhauster are subjected. In addition, in accordance with the present invention there has been provided such a new and improved exhauster for solid fuel pulverizer firing systems wherein it is possible to achieve therewith an even greater reduction in the amount of erosion to which the interior surfaces of the exhauster are subjected by applying a coating of high abrasion resistant material to such surfaces. Furthermore, there has been provided in accord with the present invention such a new and improved exhauster for solid fuel pulverizer firing systems wherein it is possible to realize therewith a reduction in the amount of leakage of airflow therefrom as contrasted to that from which prior art forms of exhausters are known to suffer. Additionally, in accordance with the present invention there has been provided such a new and improved exhauster for solid fuel pulverizer firing systems which is characterized in that it is possible therewith to achieve all of the foregoing within the existing casing of the exhauster. Penultimately, there has been provided in accord with the present invention such a new and improved exhauster for solid fuel pulverizer firing systems which is characterized in that use may be made thereof either in retrofit applications or in new applications. Finally, in accordance with the present invention there has been provided such a new and improved exhauster for solid fuel pulverizer firing systems which is characterized in that it is relatively simple in construction, relatively easy to operate, yet is relatively inexpensive to provide.

While we have illustrated and described herein a preferred embodiment of our invention, it is to be understood that such is merely illustrative and not restrictive and that variations and modifications may be made therein without departing from the spirit and scope of the invention. We, therefore, intend by the appended claims to cover the modifications alluded to herein as well as the other modifications which fall within the true spirit and scope of our invention.

What is claimed is:

1. A high efficiency exhauster for use in a solid fuel pulverizer firing system comprising:

a. a casing having an end wall and a pair of side walls, said end wall being supported in interposed relation between said pair of side walls so as to provide said casing with a substantially cylindrical configuration and so that the centerline of said casing extends through the center of each of said pair of side walls;

b. an inlet ring for introducing gas-entrained pulverized solid fuel therethrough into said casing, said inlet ring being supported in mounted relation on one of said pair of side walls so that the centerline of said inlet ring is offset relative to the centerline of said casing;

c. a rotor supported in mounted relation on the other one of said pair of side walls for rotation relative to said casing in a first direction and so that the centerline of said rotor is coaxial with the centerline of said inlet ring and is offset relative to the centerline of said casing;

d. a set of blades preselected for each given application from a multiplicity of blades of differing lengths and of differing widths in order that the high efficiency exhauster may thereby attain through the use thereof operating efficiencies of up to 70%, each of said set of blades embodying an optimum length and an optimum width established for each given application based on the specific quantity of flow, the specific static pressure and the specific horsepower desired from the high efficiency exhauster for that given application, each of said set of blades having a first end and a second end, said first end of each of said set of blades being mounted at a point on the circumference of said rotor in fixed relation thereto so as to be rotatable therewith and so as to be mounted in spaced relation one to another, said second end of each of said set of blades extending radially outward of said rotor towards said casing in a direction counter to the direction of rotation of said rotor and at an angle relative to an imaginary line drawn perpendicular to the circumference of said rotor through the point at which the corresponding said one end of each of said set of blades is mounted on the circumference of said rotor, said angle being preselected from a multiplicity of differing angles so as to be the optimum angle for each given application based on the specific flow and the specific static pressure desired from the high efficiency exhauster for that given application; and e. an outlet formed in said casing for discharging therethrough from the high efficiency exhauster gas-entrained pulverized solid fuel after the passage thereof through said casing.

2. In a solid fuel pulverizer firing system including a pulverized solid fuel-fired furnace and a pulverizer for pulverizing solid fuel for the pulverized solid fuel-fired furnace the improvement comprising a high efficiency exhauster interposed between and connected in fluid flow relation to the pulverized solid fuel-fired furnace and the pulverizer, said high efficiency exhauster comprising:

a. a casing having an end wall and a pair of side walls, said end wall being supported in interposed relation between said pair of side walls so as to provide said casing with a substantially cylindrical configuration and so that the centerline of said casing extends through the center of each of said pair of side walls;

b. an inlet ring supported in mounted relation on one of said pair of side walls so that the centerline of said inlet ring is offset relative to the centerline of said casing, said inlet ring being connected in fluid flow relation to the pulverizer for receiving therefrom and for introducing gas-entrained pulverized solid fuel therethrough into said casing;

c. a rotor supported in mounted relation on the other one of said pair of side walls for rotation relative to said casing in a first direction and so that the centerline of said rotor is coaxial with the centerline of said inlet ring and is offset relative to the centerline of said casing;

d. a set of blades preselected for each given application from a multiplicity of blades of differing lengths and of differing widths in order that the high efficiency exhauster may thereby attain through the use thereof operating efficiencies of up to 70%, each of said set of blades embodying an optimum length and an optimum width established for each given application based on the specific quantity of flow, the specific static pressure and the specific horsepower desired from the high efficiency exhauster for that given application, each of said set of blades having a first end and a second end, said first end of each of said set of blades being mounted at a point on the circumference of said rotor in fixed relation thereto so as to be rotatable therewith and so as to be mounted in spaced relation one to another, said second end of each of said set of blades extending radially outward of said rotor towards said casing in a direction counter to the direction of rotation of said rotor and at an angle relative to an imaginary line drawn perpendicular to the circumference of said rotor through the point at which the corresponding said one of each of said set of blades is mounted on the circumference of said rotor, said angle being preselected from a multiplicity of differing angles so as to be the optimum angle for each given application based on the specific flow and the specific static pressure desired from the high efficiency exhauster for that given application: and e. an outlet formed in said casing, said outlet being connected to the pulverized solid fuel-fired furnace for discharging to the pulverized solid fuel-fired furnace from the high efficiency exhauster gas-entrained pulverized solid fuel after the passage thereof through said casing.

3. The high efficiency exhauster as set forth in claim 1 wherein said inlet ring includes a first portion projecting outwardly of said casing and a second portion projecting inwardly of said casing, said first portion having a funnel-like appearance.

4. The high efficiency exhauster as set forth in claim 1 wherein said set of blades comprise twelve in number.

5. The high efficiency exhauster as set forth in claim 4 wherein each of said set of blades has a high abrasion resistant material applied to the flow engaging surface thereof.

6. The high efficiency exhauster as set forth in claim 5 wherein said high abrasion resistant material is saturated chromium carbide.

7. The high efficiency exhauster as set forth in claim 5 wherein said high abrasion resistant material is ceramics.

8. In a solid fuel pulverizer firing system the high efficiency exhauster as set forth in claim 2 wherein said inlet ring includes a first portion projecting outwardly of said casing and a second portion projecting inwardly of said casing, said first portion having a funnel-like appearance.

9. In a solid fuel pulverizer firing system the high efficiency exhauster as set forth in claim 5 wherein each of said set of blades has a high abrasion resistant material applied to the flow engaging surface thereof.

10. In a solid fuel pulverizer firing system the high efficiency exhauster as set forth in claim 9 wherein said high abrasion resistant material is saturated chromium carbide.

11. In a solid fuel pulverizer firing system the high efficiency exhauster as set forth in claim 9 wherein said high abrasion resistant material is ceramics.

* * * * *